United States Patent [19]

Oliver

[11] 4,361,914

[45] Dec. 7, 1982

[54] SHOWER CURTAIN HOLDER

[76] Inventor: Earl P. Oliver, R.R. #1, Box 15, Scottsville, Ky. 42164

[21] Appl. No.: 347,538

[22] Filed: Feb. 10, 1982

Related U.S. Application Data

[63] Continuation of Ser. No. 118,970, Feb. 5, 1980, abandoned.

[51] Int. Cl.[3] ..... A47K 3/22

[52] U.S. Cl. ..... 4/605; 4/559; 4/608; 4/609; 4/610; 160/349 R; 211/123

[58] Field of Search ..... 4/557, 559, 596, 597, 4/605, 606, 607, 608, 609, 610; 49/67; 160/349 R, 349 D, 335, 336, 338; 211/123

[56] References Cited

U.S. PATENT DOCUMENTS

| | | | |
|---|---|---|---|
| 648,454 | 5/1900 | Deland | 160/335 X |
| 871,703 | 11/1907 | Keith | 211/383 |
| 1,443,753 | 1/1923 | McClure | 160/336 X |
| 1,545,093 | 7/1925 | Gallob | 4/608 X |
| 1,632,761 | 6/1927 | Clark | 160/349 R |
| 1,654,002 | 12/1927 | Kleinhamer | 160/349 R |
| 1,746,269 | 2/1930 | Lupton et al. | 211/123 |
| 1,840,217 | 1/1932 | Wie | 160/349 R X |
| 2,085,559 | 6/1937 | Weber | 4/558 |
| 2,094,649 | 10/1937 | Gaines | 4/608 X |
| 2,107,421 | 2/1938 | Lennox | 160/349 R |
| 2,120,155 | 6/1938 | Shera | 4/608 |
| 2,232,194 | 2/1941 | Zogby | 4/558 X |
| 2,293,883 | 8/1942 | Bossert | 160/349 R |
| 3,205,547 | 9/1965 | Riekse | 160/349 R X |
| 3,382,507 | 5/1968 | Micheau | 4/558 |
| 4,139,101 | 2/1979 | Towfigh | 160/336 X |
| 4,229,842 | 10/1980 | Gilmore | 4/610 |
| 4,242,201 | 12/1980 | Stephen et al. | 4/605 X |

*Primary Examiner*—Henry K. Artis

*Attorney, Agent, or Firm*—Browdy and Neimark

[57] ABSTRACT

A device for preventing the movement of a flexible material disposed over an open area, such as a shower or a window, includes a rigid elongated rod which is held in a substantially horizontal plane intermediate the top and bottom of the flexible material. In one preferred embodiment the rigid elongated rod is maintained in a static horizontal operative position by a pivot means at one end and an attachment means at the other extremity. A holding means, such as a U-shaped hook or bracket, is attached to a wall above and in a substantially vertical plane with the pivot means to hold the elongated bar in a substantially vertical inoperative position when the bathing facility is not in use.

16 Claims, 6 Drawing Figures

SHOWER CURTAIN HOLDER

This is a continuation of application Ser. No. 118,970 filed Feb. 5, 1980, now abandoned.

FIELD OF THE INVENTION

This invention relates to a device for restraining objectionable lateral movements of curtains and drapes, and more particularly to a horizontally disposed rigid shower curtain holder.

BACKGROUND

A conventional system for eliminating the leakage or seepage of water from a shower normally comprises a plastic or cloth curtain disposed on the open side of the shower by means of attachment of the curtain to a traversal rod disposed above and parallel to the floor. As a result of the blowing or waving action of shower water it has been found desirable to hold the curtain in place to prevent water from escaping from the shower. However, for various reasons, including some noted below, prior shower curtain holders have not achieved acceptance in spite of the recognized need.

It has been well documented that many accidents occur in the bathroom area of the home and especially in the shower area, where the footing is precarious and there is a lack of static structures to support the bather during his or her shower. Various fall-prevention devices comprise the permanent attachment of a rigid static bar to a permanent wall of the shower which entails expense, such as a modification of any tile present in the bathing facility.

The U.S. Patent issued to Gallob No. 1,545,093 (1925) provides an entry flap in an encompassing shower curtain which is held in a water tight manner by a series of elongated vertically disposed snaps. In order to avoid the contact of the body of the bather with the secured shower curtain, a fabric strip is sewn in a circular manner to the circumference of the curtain approximately at a point midway the length of the curtain. Intermediate the fabric strip and the shower curtain is provided a resilient stiffening hook to keep the curtain in a cylindrical form yet permit the same to be folded back for entry or exit to the bathing facility. Such system is clearly complex and unwieldy.

Another U.S. Pat. No. 1,632,761 (1927), issued to Clark discloses a device to retard the inward and outward blowing of a window curtain and shade relative the sill of an open window. A U-shaped elongated channelled member acts to hold both the horizontal rod of the shade and the "pocket" of window curtain formed by manually bunching the curtain at a point approximately in the same horizontal plane as the shade's rod. The device relies on the pressure of the shade and would not be suitable for a shower curtain.

Kleinhammer in her U.S. Pat. No. 1,654,002 (1927) provides a cantilevered system to draw and hold a curtain. In this system, tubes of elongated structure hold the curtain on both the inside and the outside thereof. One of the tubes is pivoted to provide easy release of the curtain while the extremity opposite the wall contains a yoke and grooved clasp to insure that the curtain does not exit from between the tubes. The device is not suitable for use in conjunction with shower curtains.

Another holding device to prevent the flapping of a window shade during times of increased wind velocity is set forth in U.S. Pat. No. 1,746,269 (1930), issued to Lupton et al. A metal supported tube is provided for holding the window curtain away from the window sill. This tube is extended from the interior of the window frame by parallel tubes which are hinged on the inside of the window. Thus, when the window is closed, the metal tube may be raised to allow the curtain to hang freely from the curtain rod. This device has little or no pertinency to the holding of shower curtains.

A somewhat older device for restraining a curtain is set forth by Keith in U.S. Pat. No. 871,703 (1907). A taut coil is extended parallel to the plane of the window to inhibit the lower half of the curtain from exiting the window. The flexibility of this device detracts from any potential use it might have as a shower curtain holder. Another flexible curtain holder is disclosed in U.S. Pat. No. 2,107,421 to Lennox (1938) which is disposed similar to Keith's holder but will prohibit the curtain from blowing either inwardly or outwardly.

An apparatus is disclosed by Micheau in U.S. Pat. No. 3,382,507 which inhibits the escape of water from a shower when the same is in use. In essence, the conventional shower curtain is augmented by a plurality of vertically-disposed position-retaining flexible members, each of which possesses a magnet fixed at its lower end. Thus, a seal is formed at the lowermost end of the curtain which makes the same impervious to water leakage.

The prior art holding systems have to this date not utilized a curtain holder which horizontally traverses the entire width of the curtain and is rigid so as to not only prevent water seepage from the shower when in use but also provide a security function and additional privacy for the bather.

SUMMARY OF THE INVENTION

This invention utilizes a static rigid bar being disposed in a bathing facility at a point intermediate the top and bottom of the flexible shower curtain to hold the same in a position so as to restrain the blowing and waving motions of air and water currents. This invention is also applicable to its use on curtains and drapes disposed in windows, hallways or doors to prevent the blowing of the curtain or drapes and to hold the same in a relatively static vertical position.

This invention provides a means to eliminate the leakage of water and concomitantly provides a means of disposing a support in a shower facility in a tentative manner only when the shower curtain is drawn and the instant rigid elongated horizontal bar is attached to its respective holding means. It is simple to install; and should the bather slip, it provides a means to grasp thereby improving security.

This rigid curtain holder may be used in a stand-up shower or bathtub shower facility with equal operability to perform the respective aforementioned functions. When the shower curtain is used in a bathtub type facility the curtain will be held in place so that the bottom of the curtain will not remove itself from the inside of the bathtub. This curtain holder will also provide a bather an opportunity to run the water through the shower nozzle at any reasonable liquid throughput and not be concerned about either the blowing of the curtain or leakage of water around the perimeter of the curtain.

It is, accordingly, an object of the invention to overcome deficiencies of the prior art, such as indicated above; it is another object to provide for the improved retention of shower curtains in a simple and inexpensive, yet sturdy manner.

It is a further object of this invention to provide a static horizontally disposed apparatus for holding a shower curtain in place during the time when a bather is using the shower.

It is another object of this invention to provide a sturdy grab bar support structure within the shower or tub, by which bathers can support themselves while bathing.

A specific apparatus embodiment of this invention for the restraining of curtains comprises (a) an uppermost elongated rigid bar for maintaining the curtain in an erect position, e.g. the usual shower curtain rod; (b) a flexible shower curtain having a top portion with a plurality of eyelets attached thereto, which are in interconnection with the uppermost rod; (c) a second elongated static rigid bar disposed generally parallel to the uppermost rigid bar and intermediate the bottom of said curtain and the uppermost elongated rigid bar, wherein the second elongated rigid bar is secured to an attachment means at one extreme and a pivot means at the opposite extreme thereof and wherein the second elongated static bar traverses the entire width of the curtain; and (d) a holding means disposed above and substantially in the same vertical plane as the pivot means to hold the second elongated static rigid means in a substantially vertical position when the bathing facility is not in use.

A more specific embodiment of the invention resides in the aforementioned apparatus for inhibiting movement of a shower curtain wherein the second elongated static rigid bar is placed on the exterior side of the shower curtain to prevent the curtain from leaving the shower stall or bathtub while in use.

Another embodiment of this invention resides in the use of the aforementioned apparatus for inhibiting the movement of a shower curtain which comprises attaching the second elongated static rigid bar in the interior of the shower curtain with eyelets to interconnect the bar to the curtain at a position intermediate the uppermost elongated rigid bar and the floor of the shower stall or bathtub.

Another specific embodiment of this invention resides in the use of a telescoping bar member as the second elongated static rigid bar where the same can be pulled from the pivot means to the attachment means in a manner similar to the "rabbit ear" type of television antenna.

Yet another specific embodiment of this invention resides in the aforementioned apparatus for inhibiting the movement of a shower curtain for maintaining the second elongated static rigid bar in a substantially vertical position when not in use by a holding means disposed above and substantially in a vertical plane with the pivot means.

Another embodiment of this invention resides in the apparatus of the instant invention wherein the uppermost elongated rigid bar is a hollow aluminum shaft which receives female clips which are attached to the top portion of the shower curtain to hold the same in a vertical position. In this embodiment the second elongated rigid static bar is made of a solid or plastic material of sufficient strength to support a bather in case he or she may fall and is connected with a hook-eyelet at one horizontal extreme and attached to a pivot hinge at the other horizontal extreme.

BRIEF DESCRIPTION OF THE DRAWING

For a better understanding of the invention, as well as the above and other objects and the nature and advantages of the instant invention, a possible embodiment thereof will now be described with reference to the attached drawings, it being understood that this embodiment is to be intended as merely exemplary and in no way limitative.

DETAILED DESCRIPTION OF EMBODIMENTS

Figure 2:
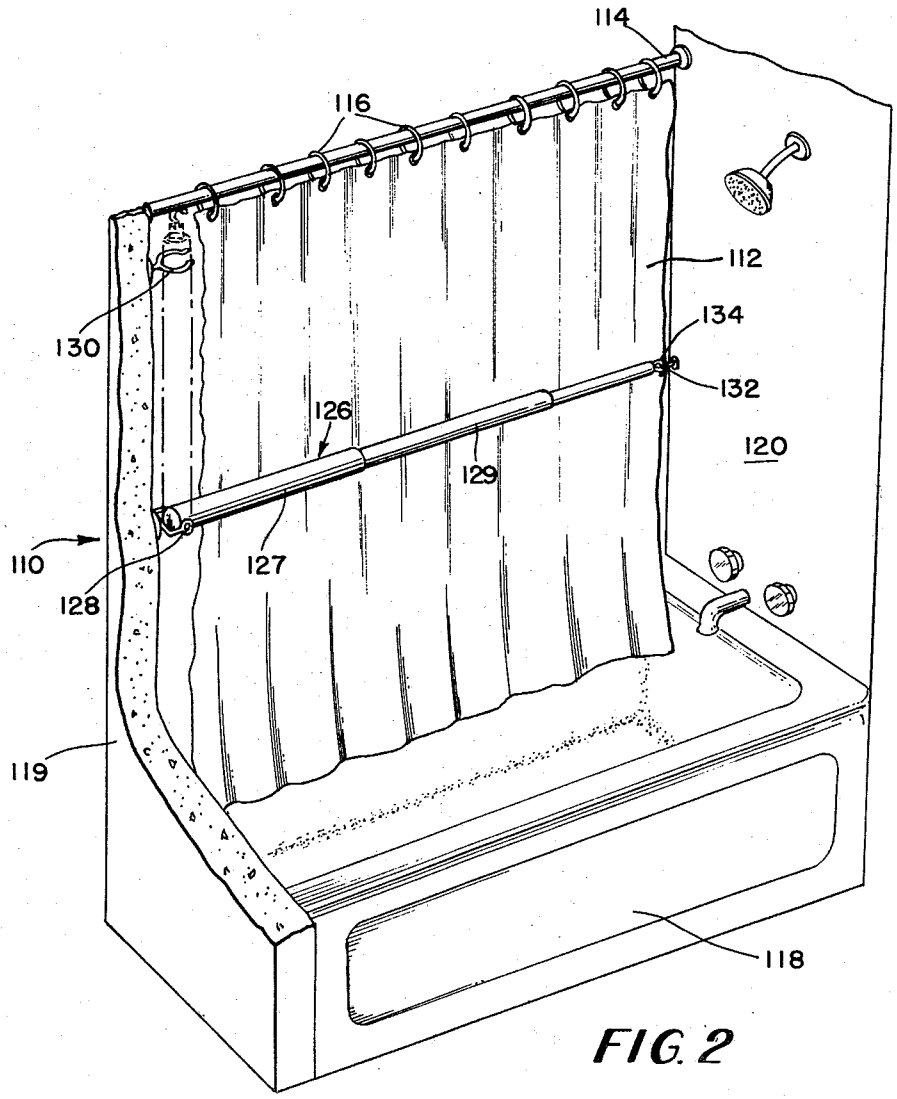
FIG. 2 is a schematic perspective view of a second embodiment.

One basic element of this invention is a flexible material which is deliberately placed over a shower opening to prevent water, wind or line of sight from penetrating the same. The specific embodiments of this invention describe this apparatus for inhibiting the leakage or seepage or water from a shower bath although the same is clearly contemplated to encompass the holding of curtains, draperies, shades and other various devices which are placed over an open area for privacy purposes.

In a specific embodiment of this shower curtain holder, the first element of importance is the shower bathing facility itself. The facility may comprise a bathtub with one or more fixtures at the top to enable water to descend upon the bather in the direction of gravity. However, this invention is also applicable to a shower stall which contains only an overhead water outlet for the purpose of showering. A second element of this apparatus is a conventional flexible shower curtain which may be made of plastic or cloth material and is secured in a vertical position by a conventional uppermost shower curtain rod which is in interconnection with the sidewalls of the shower and the flexible curtain by means of tension and attachment clips.

The important and novel aspect of this invention is the placement of a static or rigid rod which is located in a horizontal plane intermediate the top and bottom of the aforementioned flexible curtain. This rod is maintained in a substantially horizontal plane by its attachment at one extremity to a pivot means. This pivot means comprises a conventional hinge which will enable the static bar to traverse an angle of 90° so that at a position of non-use the static bar is parallel to the walls of the bathing facility. It is also contemplated within this invention that an eyelet hook may be placed at both ends of the static bar and the same manually placed in a hook and eyelet attachment before each use. Nothwithstanding, the other extreme of the static rod from the pivot means contains a wall attachment means. This will normally comprise a male hook upon the end of the static bar, which will be received by a female eyelet attached to one of the shower walls. However, any conventional attachment means may be used which is easily disengaged after use.

The instant elongated rigid bar which is placed intermediate the top and bottom of the shower curtain can be made of any material which is rigid in nature such as a plastic pipe or a hollow aluminum rod. It is contemplated within this invention that the bar may be of a telescoping nature so that it may be extended in a manner similar to a conventional television or car radio antenna. In the embodiment of this invention wherein a hinge or pivot means is used at one extreme of the bar the same can be folded at a 90° angle to be located substantially parallel to the shower wall. In such a case a holding means is placed at a distance not greater than the length of the bar and substantially in a vertical plane with the pivot means. This holding means can be nothing more than a simple U-shaped hook which will receive the bar by simply snapping the latter into the U-shape of the clip, the back portion of which is attached to the wall.

The static bar may be utilized on either the inside, outside, or both inside and outside of the shower curtain when the same is in use. In any case, the bar may conceivably be attached to the shower curtain by a series of horizontally disposed hooks or flaps in the shower curtain to insure that the shower curtain does not move away from the static bar. It is also contemplated within this invention that two such bars be used in situations where the user may be worried about a curtain moving in and out, i.e. as in a curtain covering a window sill. When the static bar is utilized in the interior position, it may be utilized by the bather for a support system to insure that the bather does not lose his footing and fall on the slippery and hard surface of the bathing facility. It is also contemplated that the elongated static bar may comprise more than one piece. If such is the case the two pieces may respectively contain male and female fittings intermediate the end portions thereof wherein the former is screwed into the latter to provide a unitary bar.

Figure 1:
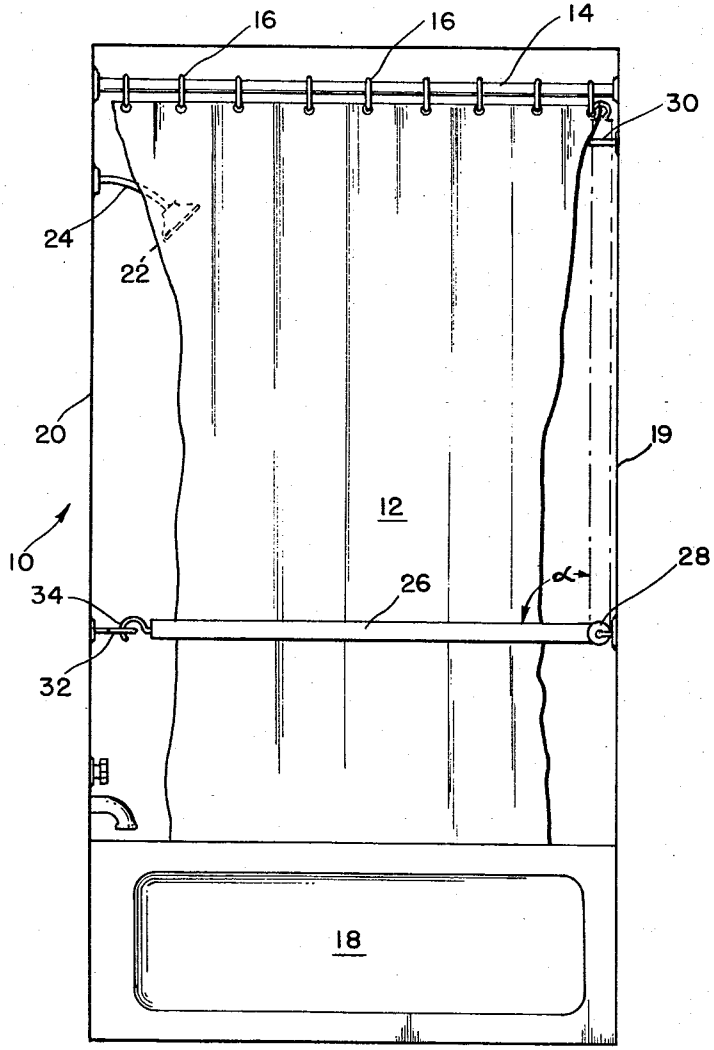
FIG. 1 is a schematic plan view of the first embodiment of the invention.

FIG. 1 shows a first embodiment 10, including a shower curtain 12, which hangs from shower curtain rod 14 by means of hooks 16 and within a bathtub 18 (or, equivalently, a shower stall). For the purpose of convenience, the shower curtain is shown partly broken away, it being understood that it would extend completely from wall 19 to wall 20. The shower is provided with a shower head 22 as is usual shown at 6 which connects with water pipe 24 for the passage of water into the bathtub 18.

The shower curtain 12 is maintained, in accordance with the invention, in position to prevent water leakage by means of a rigid horizontally placed static bar or rod 26, which runs along a horizontal line situated lower than the shower curtain rod 14 and perpendicular to the height of shower curtain 12. This bar 26 is attached to wall 19 by a pivot or hinge means 28, which allows the static tube to traverse an angle $\alpha$ equal to 90° and be fastened to a U-shaped hook or bracket 30 to the vertical position shown in phantom when not in use. A suitable hook or bracket 32, e.g. an eyelet, is fixed to the wall 20 across from the hinge 28; the end of the bar 26 is provided with a suitable mating means 34, e.g. a hook, for attachment to the eyelet 32. During the operation of the shower the bar 26 will run on the outside of the shower curtain 12 and thus prevent the same from moving. It is also contemplated that a second tube may be placed within the inside of the shower curtain or that the bar 26 alone may traverse the inside of the shower curtain, in which case it will also function as a grab bar.

Coming to FIG. 2, a tub 118 or equivalent shower stall is shown with shower space enclosing walls 119 and 120, which are in interconnection with a shower curtain rod 114. On this rod are suitable shower curtain clips or hooks 116, which hold in place the shower curtain 112. In this embodiment 110, the curtain 112 is held in place by rigid tube 126, which may run on either the inside or the outside of shower curtain 112, but in this drawing is shown to traverse the inside of the curtain. Such tube 126 is desirably telescopic in nature, having an outer section 127, a central section 129 and an inner section 131. The bar 126 is hinged to wall 119 (shown partly broken away) at a hinge 128 and connects when extended to wall 120 by mating elements 132 and 134, the male element 134 preferably being connected to the end of the bar 126 and the female element 132 to the wall 120. When not in use, the tubular bar 126 is telescoped, rotated about the hinge 128 and fitted within or otherwise attached to a suitable bracket 130.

Figure 3:
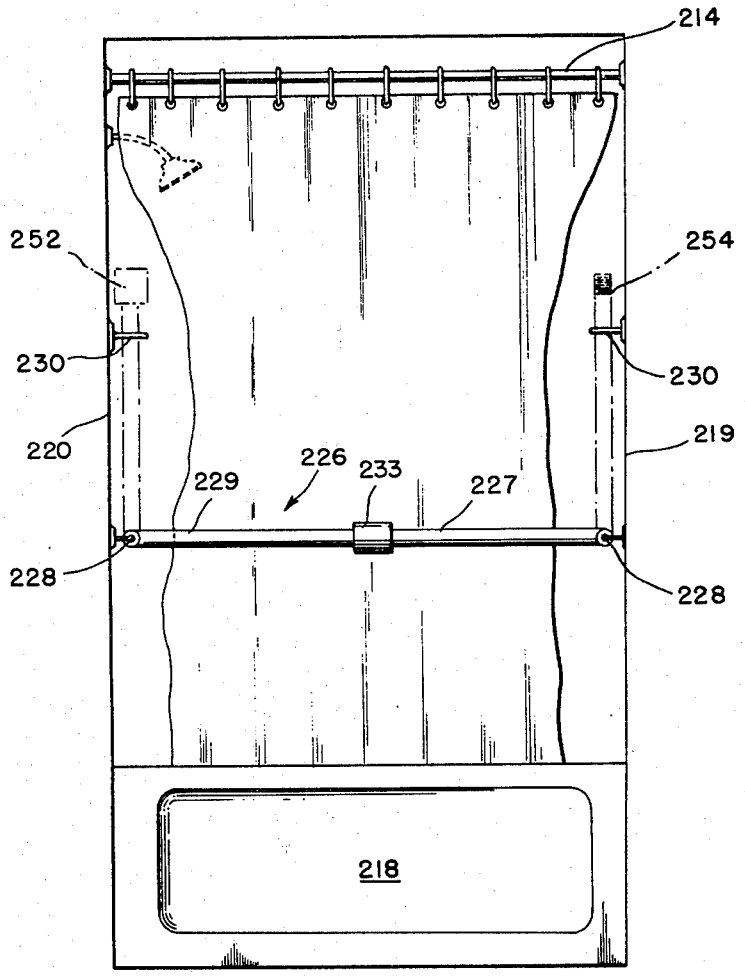
FIG. 3 is a schematic plan view of a third embodiment.

As shown in FIG. 2, a second bar 126A on the outside of the curtain could optionally be provided, and this two bar concept could also be used in the second and third embodiment described below FIG. 3 discloses a similar system 210, having a tur or shower stall 218 with walls 219 and 220 that are in interconnection with the shower curtain rod 214. In this figure, the curtain itself is not illustrated, for purposes of simplicity.

In this embodiment, the bar 226 is formed in two sections, 227 and 229, preferably of approximately equal lengths, each having a hinge 228, which hold it to its respective wall 219 or 220. This bar 226 is provided with a coupling 233 in the middle thereof to secure its two sections 227 and 229. A pair of U-shaped hooks 230 or other suitable bracket means are carried on respective walls 219 and 220 so that when not in use the tube portions 227 and 229 may be stowed away against such walls.

Figure 4:
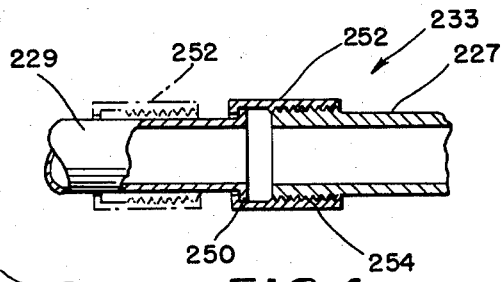
FIG. 4 is a schematic detail view of a portion of the FIG. 3 device.

In this and similar embodiments, the coupling 223 may be of construction as shown in FIG. 4. Here the bar section 227 is provided with a male threaded end 254, and the bar section 229 with a cuff 252 threaded internally to mate with the threaded end 254. The cuff 252 is loosely retained in the bar section 229 so that it can slide axially and rotate relative to both sections 227 and 229; however, an outwardly radially extending flange 250 prevents the cuff 252 from coming off the bar section 229.

Figure 5:
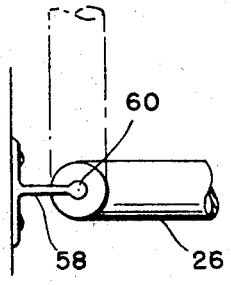
FIG. 5 is a schematic view of a hinge for use in one or more of the illustrated embodiments.

The hinges 28, 128 and 228 may be of any suitable construction. In a preferred form they are of a bracket construction 58 similar to a small and narrow toilet paper bracket, as shown in FIG. 5, formed of suitably rust and corrosion resistant metal, e.g. stainless steel or chrome plated steel, and attached to the adjacent wall, with a pivot pin 60 passing therethrough and also through the end of the bar 26, 126 or 226.

Figure 6:
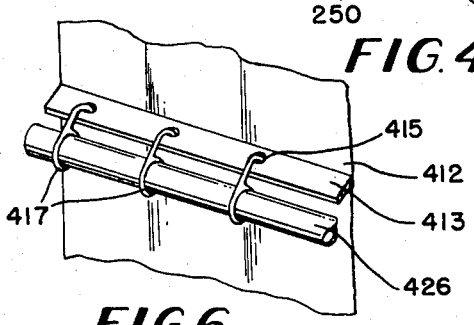
FIG. 6 is a schematic perspective view of a variation for use with the device of the invention.

FIG. 6 schematically shows a variation which can be used with any of the illustrated embodiments where the bar is used internally rather than externally of the curtain. Here the curtain 412 is provided with a flap 413 at the level of the bar 426. The flap is provided with holes 415 through which hooks, held by the bar 426, are passed to retain the curtain 412 adjacent the bar 426.

These drawings have been given as only being representative of the general embodiments of this invention and are not to be considered restrictive. Even though these drawings show only the use of this holder in a shower facility, the same can clearly be used in a window sill or any other open space where the limited movement of a flexible cloth material hanging thereover is deemed advisable.

It will be obvious to those skilled in the art that various changes may be made without departing from the scope of the invention and the invention is not considered limited to what is shown in the drawings and described in the specification.

What is claimed is:

1. An apparatus for inhibiting movement of a shower curtain and for use as a grab bar for a bather in a shower bathing facility which comprises:

(a) an uppermost elongated rigid bar for maintaining said curtain in an erect position;

(b) a flexible shower curtain having a top and a bottom portion possessing more than one eyelet attached thereto at said bottom of said curtain, wherein said eyelets are in interconnection with said uppermost rod;

(c) a second elongated rigid bar means adapted to be disposed substantially parallel to said uppermost elongated rigid bar and intermediate said top and bottom of said curtain, wherein said second elongated rigid bar means is secured to said shower bathing facility by a pivot means permanently secured to said shower bathing facility at at least one extreme of said rigid bar means when said second elongated bar means is in position where it traverses the entire width of said curtain and of said shower bathing facility; and (d) a holding means permanently secured to said shower bathing facility disposed above and substantially in a vertical plane with said pivot means to hold said second elongated rigid bar in a substantially vertical position when said second elongated rigid bar is not in use in position where it traverses the entire width of said curtain and of said shower bathing facility.

2. The apparatus of claim 1, wherein the uppermost elongated rigid bar comprises a hollow aluminum rod which will traverse from one wall of the bathing facility to a second wall of the bathing facility.

3. The apparatus according to claim 1, wherein the flexible shower curtain is made from either a plastic or a fibrous material.

4. The apparatus of claim 1, wherein said second elongated rigid bar means comprises a hollow aluminum metal conduit.

5. The apparatus of claim 1, wherein said second elongated rigid bar means comprises plastic material.

6. The apparatus of claim 1, wherein said second elongated rigid bar means comprises two elongated bars which are coupled intermediate either end by a male-female joint.

7. The apparatus of claim 1, wherein said attachment means comprises a male fitting on the extremity of said second elongated rigid bar means, which is received in a female fitting attached to one wall of said shower bathing facility.

8. The apparatus of claim 1, wherein said pivot means comprises a hinge.

9. The apparatus of claim 1, wherein said holding means comprises a U-shaped bracket attached to a wall of said showering facility.

10. The apparatus of claim 1, wherein said second elongated rigid bar means traverses an angle of 90° upon said pivot means to be received in the holding means when said shower curtain is not in use.

11. The apparatus of claim 1, further characterized in that said second elongated rigid bar is disposed on the outside of said shower curtain.

12. The apparatus of claim 1 wherein said rigid bar means comprises two elongated rigid bars one disposed on the inside and the other on the outside of the shower curtain.

13. The apparatus of claim 1, wherein said second elongated rigid bar is disposed on the inside of the shower curtain.

14. The apparatus of claim 13, wherein said second elongated rigid bar means traverses eyelets attached to the interior of the said flexible shower curtain intermediate said top and bottom portion of said shower curtain and substantially parallel to said uppermost elongated rigid bar.

15. An apparatus, for use in a shower bathing facility, for inhibiting the movement of a shower curtain which comprises an elongated rigid bar means disposed substantially intermediate the top and bottom of said curtain, wherein said rigid bar means comprises an attachment means at one extreme, a pivot means at the opposite extreme, permanently fixed to said shower bathing facility, a holding means disposed above and substantially in a vertical plane with said pivot means to hold said elongated rigid bar means in a substantially vertical position when said bathing facility is not in use, and said second elongated rigid bar means comprises a pair of bars adapted to be disposed one on the inside and the other on the outside of said shower curtain.

16. An apparatus for inhibiting movement of a shower curtain used in a shower bathing facility which comprises:

(a) an uppermost elongated rigid bar for maintaining said curtain in an erect position;

(b) a flexible shower curtain having a top and a bottom portion possessing more than one eyelet attached thereto at said top of said curtain, wherein said eyelets are in interconnection with said uppermost rod;

(c) a second elongated rigid bar means disposed substantially parallel to said uppermost elongated rigid bar and intermediate said top and bottom of said curtain, wherein said second elongated rigid bar means is secured to an attachment means at one position and a pivot means at one extreme of said rigid bar and wherein said second elongated static bar traverses the entire width of said curtain; and (d) a holding means disposed above and substantially in a vertical plane with said pivot means to hold said second elongated rigid bar in a substantially vertical position when said bathing facility is not in use; and (e) said second elongated rigid bar means comprising a pair of bars adapted to be disposed one on the inside and the other on the outside of said shower curtain.

* * * * *